United States Patent [19]

Giurlani

[11] Patent Number: 4,785,602

[45] Date of Patent: Nov. 22, 1988

[54] CONSTRUCTION PANEL

[75] Inventor: Marco O. Giurlani, Urb. La Castellana, Venezuela

[73] Assignee: Corporacion Maramar C.A., Caracas, Venezuela

[21] Appl. No.: 121,819

[22] Filed: Nov. 23, 1987

Related U.S. Application Data

[63] Continuation-in-part of Ser. No. 922,459, Nov. 23, 1986, abandoned.

[51] Int. Cl.[4] ..... E04C 2/26

[52] U.S. Cl. ..... 52/309.12; 52/405; 52/454

[58] Field of Search ..... 52/405, 309.11, 309.12, 52/309.4, 454, 574, 407

[56] References Cited

U.S. PATENT DOCUMENTS

| | | | |
|---|---|---|---|
| 1,694,542 | 12/1928 | Hedden | 52/381 |
| 2,187,959 | 1/1940 | Williams | 52/381 |
| 4,393,636 | 7/1983 | Rockstead | 52/381 |
| 4,454,702 | 6/1984 | Bonilla-Lugo | 52/405 |

*Primary Examiner*—John E. Murtagh

*Attorney, Agent, or Firm*—Howard J. Greenwald

[57] ABSTRACT

A construction panel with improved physical properties is disclosed. This panel is comprised of a wire-mesh framework, an insulating core disposed within the framework, and means for disposing the insulating core within the framework and connecting the core to the framework. The wire-mesh framework is a closed, four-sided structure with a front side, a back side, a left side, a right side, a first alignment guide, and a second alignment guide. Cross-tie separators pass through the insulating core and are attached to the wire mesh framework at spaced points.

20 Claims, 14 Drawing Sheets

CONSTRUCTION PANEL

CROSS-REFERENCE TO RELATED APPLICATION

This application is a continuation-in-part of applicant's copending application Ser. No. 922,459, filed Nov. 23, 1986, now abandoned.

TECHNICAL FIELD

An insulated construction panel is described. This panel contains a wire mesh framework, an insulating core fixedly disposed within said framework and at least two cross-tie separators per square foot of panel.

BACKGROUND OF THE INVENTION

There are many construction panels disclosed in the prior art. Thus, by way of illustration, prior art construction panels are disclosed in U.S. Pat. Nos. 4,454,702 of Bonilla-Lugo, 4,253,288 of Chun, 4,541,164 of Indave, 4,509,019 of Deinzer, and 1,824,091 of Magee.

Many of the prior art construction panels are insulated; they often have an insulating core disposed within a wire mesh framework. However, with these prior art panels, the insulating core is usually not fixedly disposed within the wire mesh framework; and, when concrete is applied to the framework, the insulating core is displaced and/or deformed.

The prior art construction panels are usually set in place at the construction site, and then cementitious material is applied to opposing faces of the panel. Cementitious material is generally applied first to one face of the construction panel and then to the other face.

One suitable cementitious material often used with construction panels is concrete. When wet concrete is applied to the face of a wire mesh framework/insulating core construction panel, it exerts a substantial amount of force. Thus, for example, a pressure of about 24 pounds per square foot being applied to the faced of an insulating core during concrete application is not uncommon.

If the insulating core of the construction panel is displaced during concrete application, the final product will not have uniform properties. There will be more concrete on one side of the panel than on the other side, and, depending upon the order in which different faces of different panels have concrete applied to them, different panels may have differing amounts of concrete on adjacent sides. Furthermore, if the insulation core is displaced sufficiently so that one of its sides touches the wire mesh framework at one or more places, the strength properties of the panel may be adversely affected.

One proposed solution for solving the problem of displacement of the insulating core during application of the cementitious material is disclosed in U.S. Pat. No. 4,454,702 of Bonilla-Lugo. Bonilla-Lugo discloses a construction panel made from a wire mesh sheet which measures 60 inches by 96 inches (see lines 63–65 of column 4 and FIGS. 5*a* and 5*b*) and whose wire mesh forms 6 inch×6 inch openings. The average width of the Bonilla-Lugo construction panel is 3.5 inches, the average length of the panel is 28.25 inches, the average width of the construction core used in the panel is 2.5 inches, and the average length of the construction core is 20 inches (see lines 17–21 of column 5 and FIGS. 3*a* and 3*b*).

In order to fixedly secure his insulating core within the wire mesh framework, Bonilla-Lugo uses a multiplicity of concrete block separators. These separators appear to be tied in place through the insulating core, but they do not appear to be attached to the wire mesh framework (see lines 6–9 of column 5).

There are not very many concrete block separators used in the construction panel of Bonilla-Lugo. This, as is illustrated in FIGS. 1 and 11 of the Bonilla-Lugo patent, for every 40 square feet of 8′×5′ construction panel, there are only 8 concrete block separators. The use of only 0.2 separators per square foot of the Bonilla-Lugo construction panel is not sufficient to adequately prevent the insulating core from being displaced from its set position during concrete application, especially since the separators do not appear to be secured to the wire mesh framework.

It appears that one of the primary reasons Bonilla-Lugo does not use more concrete separators in his construction panel is to maintain its light weight. The construction panel of Bonilla-Lugo "... weighs 1 lb/sq. ft. and because it is light weight it is easy to handle ..." (see lines 26–27 if column 5). The use of the eight block separators shown in FIG. 1 adds about 0.3 pounds/square foot of weight to the Bonilla-Lugo panel; and, if substantially more concrete block separators and/or substantially thicker concrete block separators were used, the construction panel of Bonilla-Lugo would be substantially heavier.

There appear to be only a limited range of widths which can be used for the concrete separators in the Bonilla-Lugo construction panels. Thus, as is disclosed on lines 17–23 of column 5, the concrete separators may range in size from 0.5 inches to 1.0 inches. Wider concrete separators apparently cannot be used in the construction panel of Bonilla-Lugo; if they were used, they might make the panel prohitively heavy.

In construction panels used for ceiling and roof sections, the insulating foam core should be disposed within the wire mesh framework so that the separation between the top side of the wire mesh framework and the top face of the insulating foam core is substantially greater than the separation between the bottom side of the wire mesh framework and the bottom face of the insulating foam core. This is so because the upper part of the ceiling panel is usually subjected to a substantial amount of compressive load. The former separation preferably ranges from about 1.0 to about 3.0 inches.

It is an object of this invention to provide an insulated building panel which is self-aligning. It is another object of this invention to provide a building panel in which a foam insulating panel is fixedly disposed within a wire mesh framework. It is another object of this invention to provide a building panel which is lightweight. It is yet another object of this invention to provide a building panel which, for a given wire gage and weight of insulating panel, has a substantially constant weight per linear foot of wire mesh used regardless of the distances used between the wire mesh framework and the faces of the foam insulating core.

SUMMARY OF THE INVENTION

In accordance with this invention, there is provided an inexpensive construction panel with improved physical properties. The panel is comprised of a wire mesh framework, an insulating core fixedly disposed within said framework, and at least 2.0 cross-tie separators per sqaure foot of the construction panel. The wire mesh framework is a closed, four-sided structure comprised of a front side, a back side, a left side, a right side, a first alignment guide, and a second alignment guide.

BRIEF DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

The construction panel of this invention is comprised of a multiplicity of cross-tie separators. As used in this specification, the term "cross-tie separator" has a very specific meaning. It refers to a device, which usually is comprised of at least four wires, which is attached to both opposing faces of the wire mesh framework of the panel and also clamps both opposing faces of the insulation core. The cross-tie separators used in the panel of this invention serve the following essential functions: (1) they fix the insulation core firmly in place, disposing it inside and within the wire mesh framework, and (2) they reinforce the wire mesh framework. The former function helps to insure the structural integrity of the construction panel when concrete is being applied to it. The latter function helps strengthen the construction panel without adding a prohibitive amount of weight to it.

Figure 1:
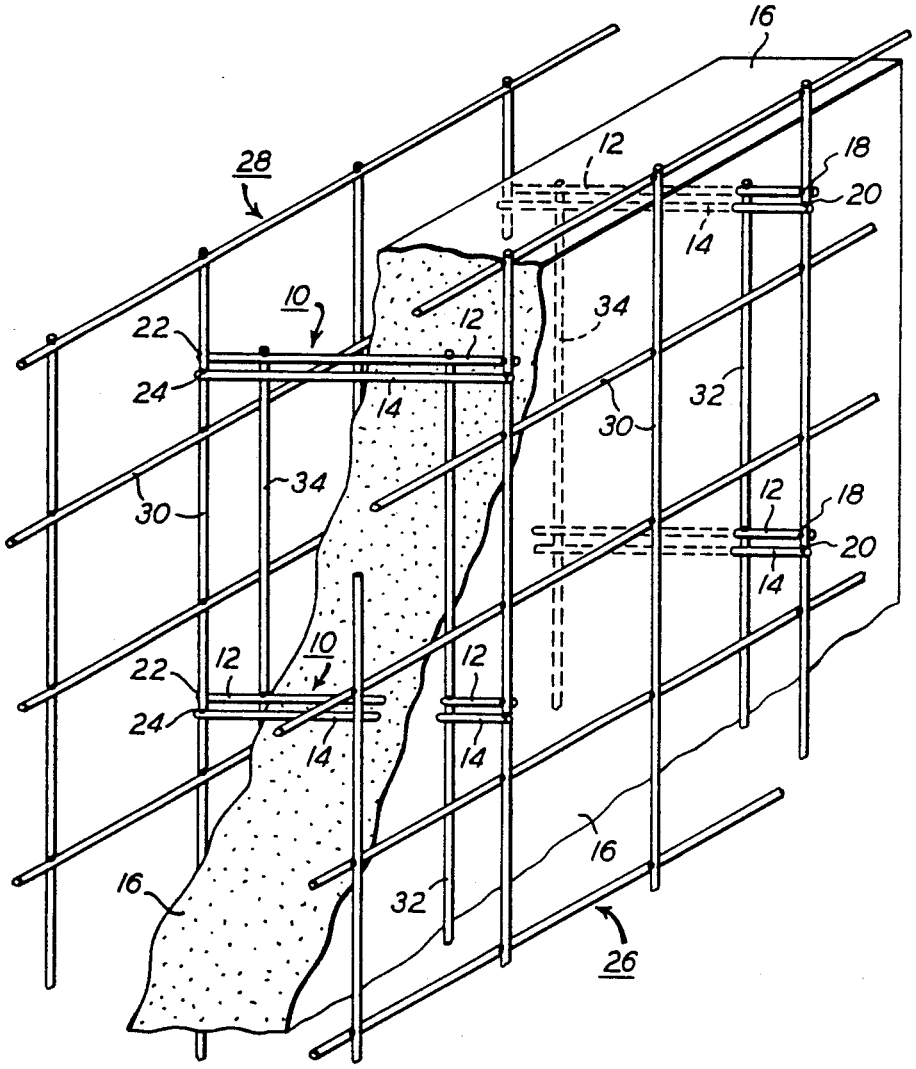
FIG. 1 is a broken-away, partial cross-sectional view of the construction panel of this invention.

FIG. 1 is a broken-away, partial cross-section of the construction panel of this invention which illustrates the cross-tie separator used in said panel. Cross-tie separators 10 are comprised of wires 12 and 14, both of which pass through insulating core 16 and are attached at points 18, 20, 22, and 24 of opposing faces 26 and 28 of wire mesh framework 30. Wires 12 and 14 are substantially parallel to each other. Each of wires 12 and 14 form an angle of from about 80 to about 100 degrees at points 18, 20, 22, and 24 where they are connected to the opposing faces of the wire mesh framework; and each of these wires 12 and 14 also form an angle of from about 80 to about 100 degrees at the points at which they intersect opposing faces of the insulating core.

In addition to being comprised of substantially parallel wires 12 and 14, each of the cross-tie separators is also comprised of substantially parallel wires 32 and 34. Wires 32 and 34 are substantially perpendicular to wires 12 and 14, forming an angle of from about 80 to about 100 degrees therewith.

The use of a multiplicity of cross-tie separators in applicant's invention, in addition to providing structural integrity and increased strength, creates another significant advantage: it makes the concrete sprayed onto the building panel substantially more likely to stick to the panel. Many of the prior art panels suffer from the disadvantage that concrete which is sprayed onto them is likely to fall off to some degree due to the force of gravity; this is a serious problem when, e.g., one is coating the bottom of a prior art ceiling building panel. With applicant's construction panel, however, this problem is substantially reduced and often eliminated. Without wishing to be bound by any particular theory, applicant believes that concrete is more likely to stick to his panel than to prior art building panels because of the multiplicity of wires present in this preferred cross-tie separators.

To the best of applicant's knowledge and belief, no one in the prior art has disclosed a construction panel comprised of a multiplicity of cross-tie members each of which is comprised of at least four wires, two of which clamp an insulation core 16 into place, and two of which secure the insulation core to the wire mesh framework by having their ends secured to the wire mesh framework.

The construction panel of this invention is comprised of at least two cross-tie separators per square foot of panel. The number of square feet in the construction panel of this invention is calculated by multiplying the height of the panel by its width. Thus, referring to FIG. 7, the length of alignment lips 74 and 76 is not included in the width for the purposes of calculation of the surface area for this purpose. Thus, the width of the panel is the distance between points 72 and 73 or between points 71 and 70, and the height of the panel is the distance between points 70 and 72 or between points 71 and 73.

It is preferred that there be at least 2.5 cross-tie separators per square foot of panel, and it is more preferred that there be at least 3.0 cross-tie separators per square foot of panel.

In one embodiment, the cross-tie separator members are spaced substantially equidistantly across the width of the panel wherein, as defined above, the width excludes the length of the alignment lips. In an even more preferred embodiment, the cross-tie separator members are spaced substantially equidistantly over both the width and the length of the surface of the panel.

The construction panel of this invention appears to be substantially light than most of the prior art construction panels such as, e.g., the panel disclosed in U.S. Pat. No. 4,454,702 of Bonita-Lugo. Bonita-Lugo states that the construction panel of his invention weighs 1 pound per square foot (see column 5, line 26). However, he fails to specify either the weight (gage) of the wire used in his panel or the amount of wire used per square foot cross-section of his panel. It should be noted that the 1 pound per square foot weight specified by Bonilla-Lugo does not appear to include the vertical joist 1 which is connected to the Bonilla-Lugo construction panel once it has been fabricated (see lines 29–34 of column 5).

The construction panel of this invention preferably has an adjusted weight of less than 0.8 pounds per square foot, and there is no need to subsequently attach it to a wire joist once it has been fabricated. The weight of the construction panel is calculated with regard to the standard panel illustrated in FIG. 2. Thus, referring to FIG. 2, the width of this standard panel 11 ("t") is 3.5 inches, the length of this standard panel 13 ($\frac{1}{2}[w-t]$) is 28.25 inches, the width of the insulation core 15 ("a") is 2.5 inches, the length of the insulation core 17("b") is 20 inches, and the distance 19 between the ends of the insulation foam and the wire cage is 1.0 inch. It should be noted that the dimensions of this construction panel were chosen in order to be as comparable as possible to the construction panel disclosed by Bonilla-Lugo, and the "t," "w," "b," and "a" designations are those used in the Bonilla-Lugo patent.

Figure 2:
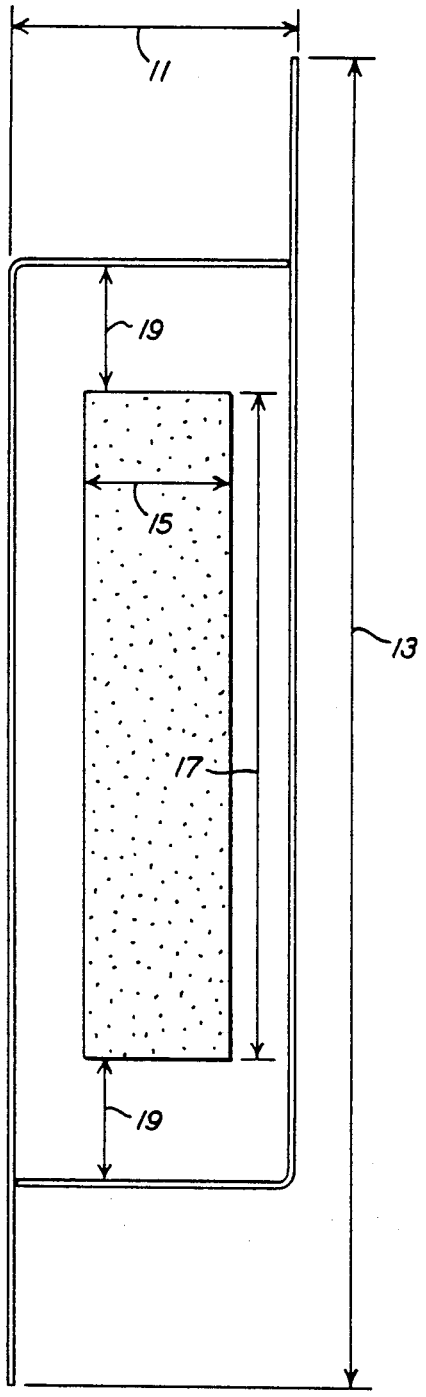
FIGS. 2, 7, and 9 are sectional views of some of the construction panels of this invention.

In the standard panel disclosed in FIG. 2, 8.5 gage wire is used for the cage structure of the panel, and 14 gage wire is used for the wire separators and the ties used in the panel. For the calculation of the weight per unit area, the surface area of this standard panel is calculated by multiplying its height (96 inches) by its length (28.25 inches) and then multiplying the result obtained by two. In this panel, there is an average of 12 feet of 8.5 gage wired used, and there is an average of 11 feet of 14 gage wire used.

As those in the art will readily recognize, when any of the parameters of the standard panel is modified, the weight of the panel will be changed. Thus, if one doubles the weight of both the wire used for the cage structure and the wire separators and ties, and everything else is kept the same, then the panel will weigh twice as much; and a construction panel which has such heavier gage wire in it and which weights less than 1.6 pounds per square foot is deemed to " . . . weight less than 0.8 pounds . . . " The "adjusted weight" of this panel is " . . . less than 0.8 pounds per square foot . . . " within the meaning and scope of this invention. Thus, if one doubles the length of both the wire used for the cage structure and the wire separators and ties, and everything else is kept the same, then the panel will weigh twice as much; and a construction panel which has such longer wire in it and weighs less than 1.6 pounds per square foot is deemed to " . . . weigh less than 0.8 pounds . . . " within the meaning and scope of this invention.

The gage of the wire used in the cross-tie separators can be the same as the gage of the wire used in the wire mesh framework, or it may be different. When a different gage is used, it is preferred that a lighter gage be used for the cross-tie separators than is used for the wire mesh framework. In one embodiment, from about 8 to about 14 gage wire is used for the cross-tie separators and from about 6 to about 14 gage wire is used fo the wire mesh framework. In this embodiment, the weight of the cross-tie separators, per unit of length, is from about 50 to about 80 percent of the weight of the wire mesh framework, per same unit of length.

As long as all the requirements for the cross-tie separators which are mentioned above are met, one may use many different means of providing cross-tie separators. Thus, for example, one can use cross-tie separators which are not connected to each other. Alternatively, and preferably, one can use cross-tie separators which are connected to each other.

Figure 3:
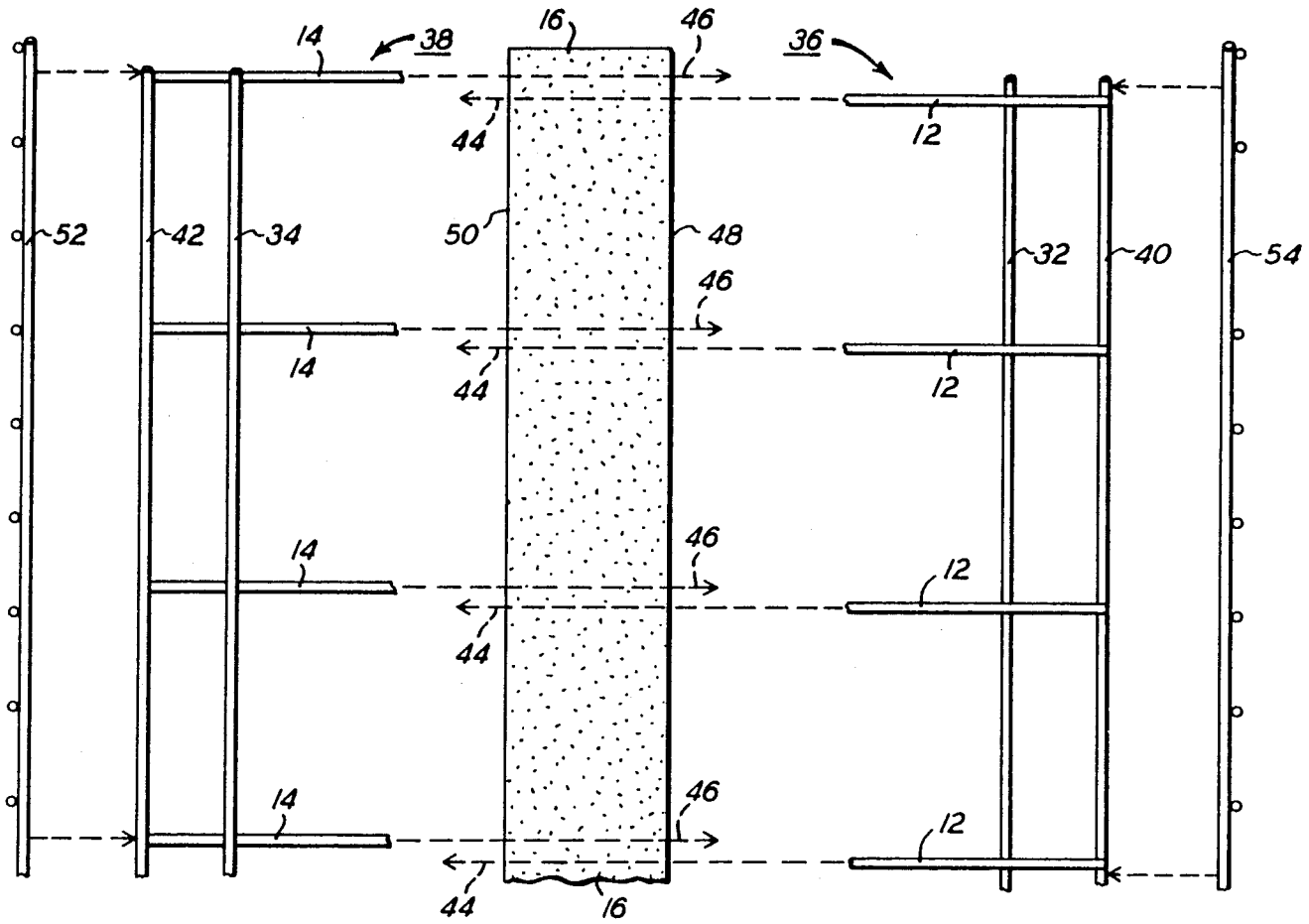
FIG. 3 is a sectional view of some of the prongs used to form the construction panel of this invention.

FIG. 3 illustrates a preferred means of providing cross-tie separators which are connected to each other. Referring to FIG. 3, prongs 36 and 38 are used to provide a multiplicity of connecting cross-tie separators. These prongs 36 and 38 are comprised of a multiplicity of wires 12 and 14, respectively; these wires 12 and 14 are shown broken away. Each of prongs 36 and 38 is also comprised of wires 32 and 34, respectively. Furthermore, each of prongs 36 and 38 is also comprised of wires 40 and 42, respectively.

In the preferred embodiment illustrated in FIG. 3, each of wires 40 and 42 is parallel to wires 32 and 34, respectively. It is preferred that each of wires 32 and 40 be welded to each of tines 12 at the points where they intersect. Likewise, it is preferred that each of wires 34 and 42 be welded to each of tines 14 at the points where they intersect.

As is shown by arrows 44 & 46 on FIG. 3, tines 12 are pushed through face 48 of insulating core 16 so that they form a substantially perpendicular angle when they intersect face 48 of insulating core 16. Similarly, tines 14 are pushed through face 50 of insulating core 16 so that they form a substantially perpendicular angle when they intersect face 50. Tines 12 extend through insulating core 16, past wire 42, and to wire mesh framework 52. Tines 14 extend through insulating core 16, past wire 40, and to wire mesh framework 54.

Figure 4:
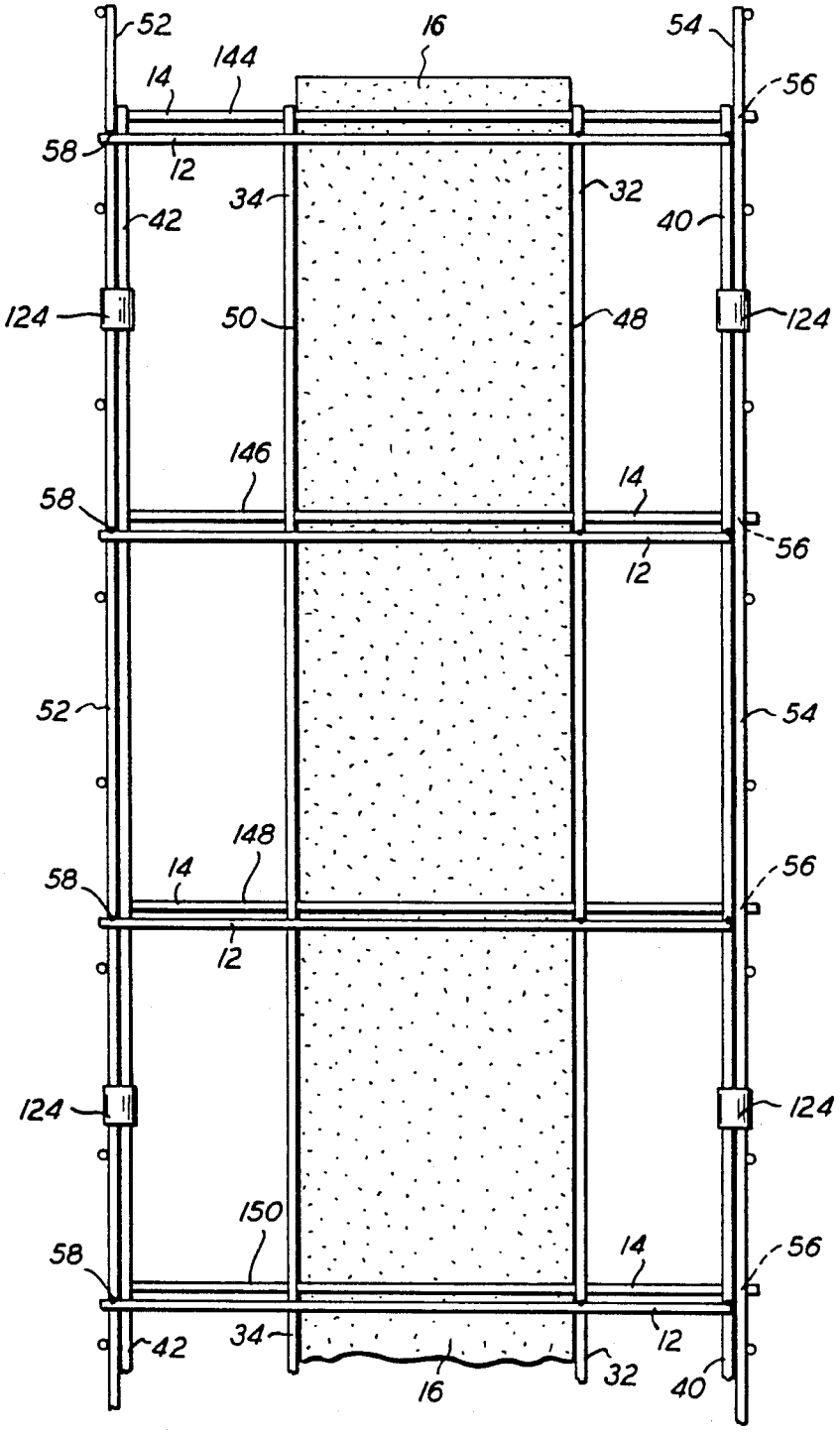
FIG. 4 is a sectional view of the constructed panel of this invention.

The completed construction panel made by the process illustrated in FIG. 3 is shown in FIG. 4. Wires 52, 42, and 34 are parallel to each other, and each of them are substantially parallel to face 50 of insulating core 16. Wires 54, 40 and 32 are parallel to each other, and each of them are substantially parallel to face 48 of insulating core 16. Wires 32 and 34 are parallel to each other. Each of wires 32, 34, 40, 42, 52, and 54 intersect each of tines 12 and 14, and at each of said intersections a substantially perpendicular angle (from about 80 to about 100 degrees) is formed. Each of tines 12 is parallel to each of other tines 12 and to all of the tines 14; and each of tines 14 is parallel to each of the other tines 14 and to all of the tines 12.

The ends of tines 12 and 14 are secured to faces 52 and 54 of the wire mesh framework, wherein they are secured to the wire mesh framework at points 56 and 58. The ends of tines 12 and 14 may be secured to faces 52 and 54 of the wire mesh framework by welding them, by mechanical means (bending, crimping, etc.), or by some combination of welding and mechanical means.

As is illustrated in FIGS. 3 and 4, the construction panel of this invention may be constructed by connecting together wire mesh insulating core 16, prongs 36 and 38, and wire mesh members 52 and 54. Means for making wire mesh members 52 and/or 54 are illustrated in FIGS. 5 to 6.

Figure 5:
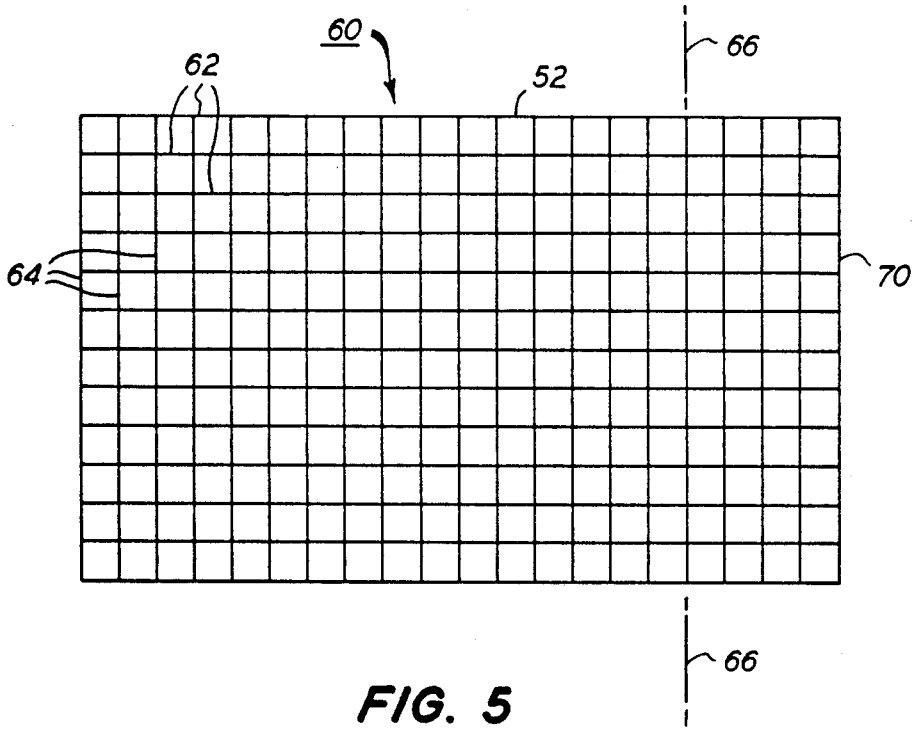
FIG. 5 is a partial sectional view of the wire mesh used in the process of this invention.
Figure 6:
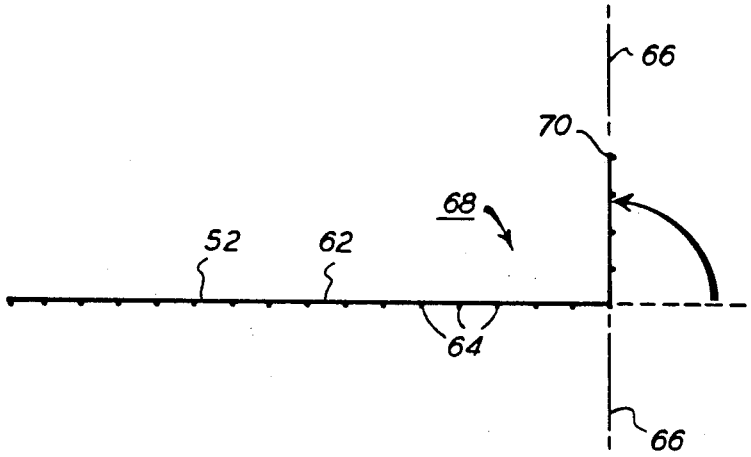
FIG. 6 illustrates how an alignment guide is formed from the wire mesh used in the process of this invention.

FIGS. 5 and 6 illustrate one process for making one of the preferred construction panels of the invention. In this process, two wire mesh panels 60 are fabricated. Each of these pieces is approximately 96.5 inches long by about 60 inches high. The horizontal wires 62 and the vertical wires 64 in these pieces are so arranged that the shapes formed by them are square with a size of about 1.0"×1.0".

These two rectangular wire mesh pieces may be fabricated from 12 guage galvanized steel (available from Sidor of Caracas, Venezuela) with a "GZ" wire mesh welding machine for light wire mesh available from EVG EntwicklungsOund Verwertungs-Gesellschaft m.b.h. H., Graz, Austria.

Thereafter, the rectangular mesh piece 60 is bent along bend line 66 to form wire mesh piece 68. Bend line 66 must be at least about 3.5 inches from one end 70 of wire mesh piece 60 at an angle of from about 82 to about 90 degrees.

Figure 7:
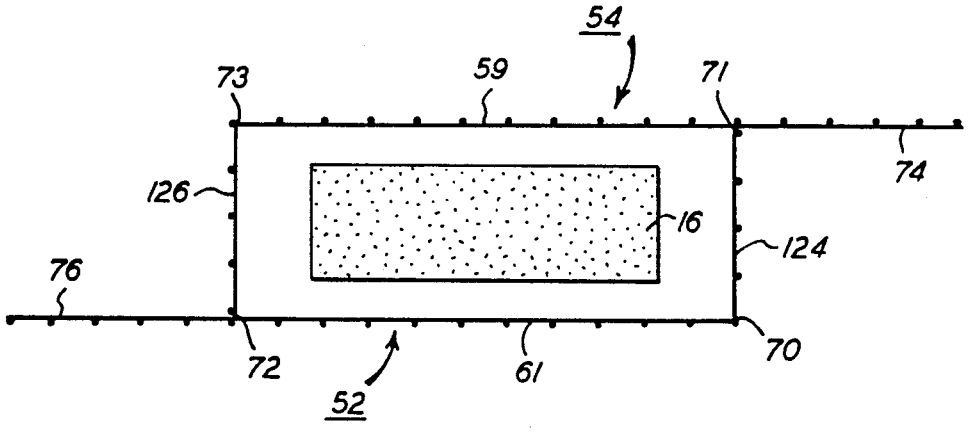

One of the constructed wire mesh framework pieces, 52, is shown in FIG. 6. Another such piece 54 is connected to the ends of tines 12 and 14 (see FIGS. 3 and 4) and also to the other wire mesh framework piece, as is shown in FIG. 7 (in which details of the cross-tie separators are omitted for the sake of clarity). One end of wire mesh piece 52 is connected at point 71 of wire mesh piece 54, and one end of wire mesh 54 is connected at point 72 of wire mesh piece 52. Points 71 and 72 are chosen so that each of alignment lips 74 and 76 extend past points 71 and 72 respectively, by at least about six inches and, preferably, at least about seven inches. In the most preferred embodiment, each of alignment lips extends past points 71 and 72, respectively, by at least about 8 inches. Each of alignment lips 74 and 76 may extend different lengths past points 71 and 72, respectively, but it is preferred that they extend the same distance past said points.

Figure 8:
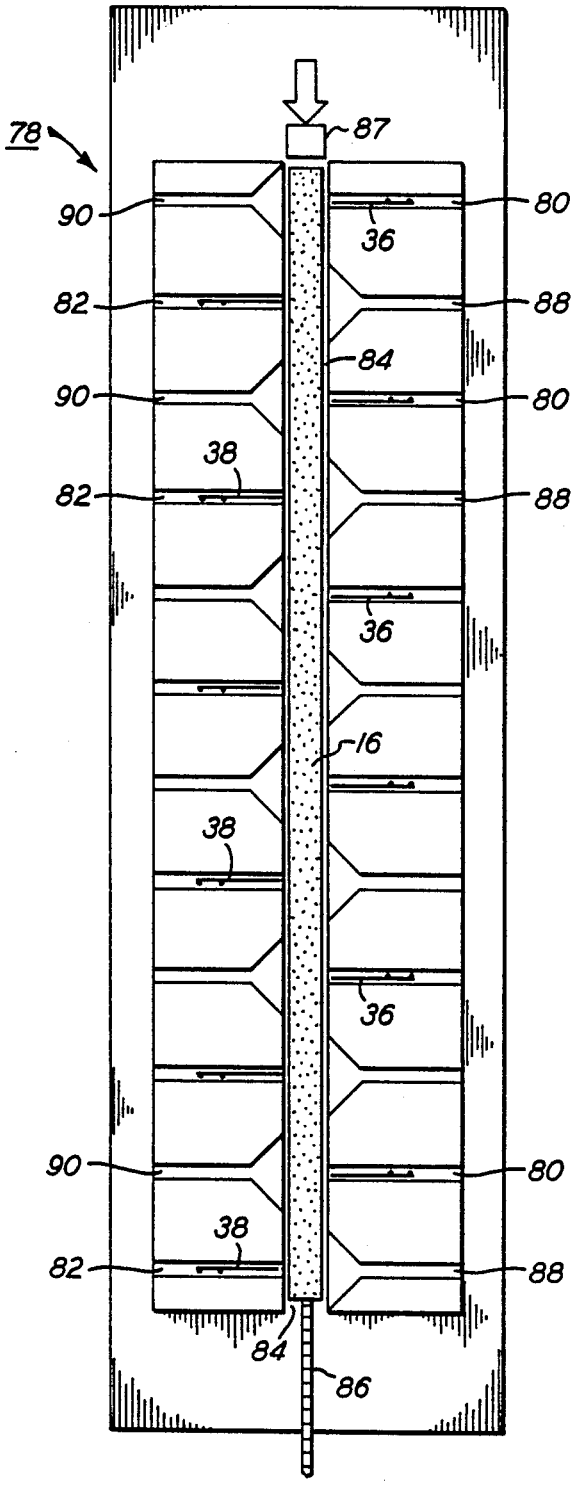
FIG. 8 is a cross-sectional view of a machine which can be used to prepare the construction panel of this invention.

One alternative method of making the construction panel of this invention is illustrated in FIG. 8. In the process illustrated in this Figure, prongs 36 and 38 are first manufactured on a separate welding machine (not shown) which has the capability of varying the length of tines 12 and 14, the spacing between wires 32 and 40, the spacing between wires 34 and 42, the spacing between tines 12 and 14, the spacing between adjacent tines 12, the spacing between adjacent tines 14, and the like.

Prongs 36 and/or 38 are introduced into machine 78 and, in particular, into channels 80 and 82. The distance between adjacent channels 80 and 82 can be varied on the machine, thereby varying the distance between tines 12 and 14. The distance between adjacent channels 80 and between adjacent channels 82 can also be varied, thereby varying the spacing between adjacent cross-tie separators. A multiplicity of prongs 36 and/or 38 can be introduced into each channel 80 and into each channel 82, and the spacing between each prong can be varied on the machine.

A substantially rectangular foam insulation core 16 is introduced into channel 84 of the machine, wherein it is pulled into place by chain apparatus 86 and compressed by press 87. Means are provided for positioning foam insulation core 16 either in the center of or off-center in channel 84.

The introduction of foam insulation core 16 into channel 84 activates chain apparatus 86, whose activation starts other processes. On each side of the machine, a roll of wire mesh is unrolled, and it is bent into wire mesh framework pieces 52 and 54 at a point downstream from the prong pressing operation.

Prongs 36 and 38 are pressed through channels 80 and 82, through insulation core 16, and partially into channels 88 and 90. Pressing may be accomplished by automatic pressing means.

Thereafter, insulation core 16 with tines 12 and 14 extending through both sides of it is passed further into channel 84 via chain apparatus 86 to a downstream station within channel 84 wherein wire mesh framework pieces 52 and 54 are automatically pressed onto the insulation core. Each of these wire mesh framework pieces 52 contains alignment tabs 74 and 76. The insulation core 16 with tines 12 and 14 extending through both sides of it is disposed in the middle of wire mesh framework pieces 52 and 54 by the machine (see FIG. 7 and wire mesh framework pieces 52 and 54 are automatically pushed towards each other and insulating core 16; they are restrained by wires 40 and 42 of prongs 36 and 38, respectively.

Thereafter, chain apparatus 86 transports the partially constructed panel downstream to another station where the ends of tines 12 and 14 are connected to wire mesh framework pieces 52 and 54 by either welding and/or mechanical menas (such as bending).

Thereafter, the panel is moved still further downstream to another station within channel 84 wherein the construction panel may be cut to fhe desired size.

Figure 9:
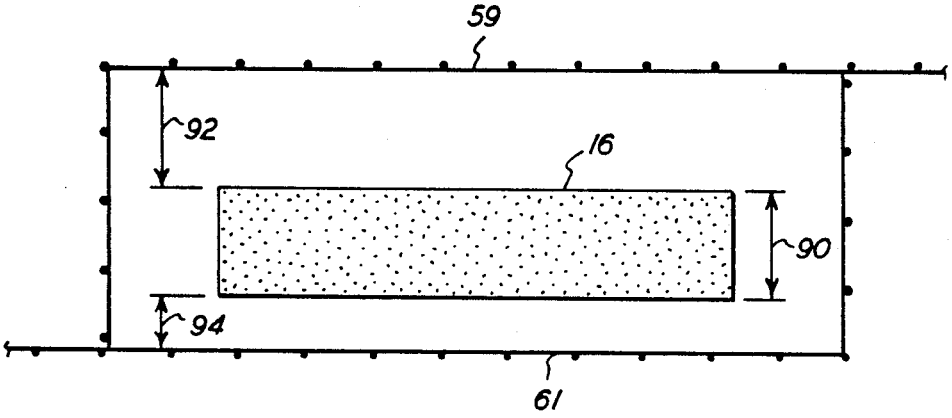

FIG. 9 illustrates some of the preferred embodiments of the construction panel of this invention. Cross-tie separators have been omitted from this Figure to simplify understanding of some of the dimensions presented.

In FIG. 9 the width of insulation core 16 is identified as 90, the distance between the bottom face of wire mesh face 54 and the upper face of insulation core 16 is identified as 92, and the distance between the lower face of insulation core 16 and the upper face of wire mesh 52 is 94.

Unlike many prior art construction panels, the construction panel of this invention may readily be utilized for ceiling panels without substantially increasing its weight per square foot. It is desirable in ceiling panels that distance 92 be at least 2.0 times distance 94, for the upper part of the ceiling panel (represented by distance 92) is subjected to a substantial amount of compressive load. It is preferred that, for ceiling panel applications, distance 92 be from about 1.0 to about 3.5 inches, distance 90 be from about 1.5 to about 3.0 inches, and distance 94 be from about 0.5 to 1.0 inches. However, in all cases the ratio of distance 92 divided by distance 94 should always be at least 2.0.

With regard to distance 92, the lower distance (1.0 inch) should only be used for relatively short spans of panel. For longer spans, with greater loads, the larger distances 92 must be used.

The panels of U.S. Pat. No. 4,454,702 of Bonilla-Lugo are not well suited for use as building panels. If Bonilla-Lugo wants to increase distance 92 from 0.5 inch (which is what he uses in his wall panels) to, e.g., 3.5", he must increase the size of his concrete separators 700%; and he thus must increase the weight of his concrete separators 700%. Bonilla-Lugo indicates that this is not a possibility, disclosing (at column 5, lines 22–23) that the maximum size of his concrete block separators is 1.0 inch.

The construction panel of this invention is also advantageously used for wall panels. In this use, it is preferred that distance 94 be substantially equal to distance 92 and range from about 0.5 to about 1.5 inches. In this application, distance 90 generally ranges from about 1.5 to about 3.0 inches.

The construction panel of this invention is comprised of rigid mesh framework. Any material which is sufficiently rigid can be used to make the mesh framework.

In one embodiment, the mesh is made out of a metal and/or a metal alloy. Some suitable metals and metal alloys are described in Table 23-5 which appears on pages 23-38 to 23-53 of Robert H. Perry's and Cecil H. Chilton's "Chemical Engineers' Handbook," Fifth Edition (McGraw-Hill Book Company, New York 1973), the disclosure of which is hereby incorporated by reference into this specification.

In one embodiment, the mesh is made out of a low-temperature material. In this embodiment, it is preferred that the low-temperature material be resistant to shock and have a Charpy value of at least about 20 foot-pounds. Thus, for example, steels, stainless steels (such as, e.g. types 304 and 304L), nickel steel, aluminum alloys (such as the aluminum-magnesium and the aluminum-magnesium-manganese materials), and copper alloys can be used. These materials are described at pages 23-70 and 23-71 of the Perry and Chilton's "Chemical Engineers' Handbook," specification.

In another embodiment, the mesh is made out of a high-temperature material. Suitable high-strength materials include, e.g., metal alloys, such as carbon and alloy steels, ferritic steels, austenitic steels, nickel-based alloys, cast irons, cast stainless, and super alloys. These alloys are described in Tables 23-18 and 23-19 (at pages 23-70 and 23-71) of the aforementioned Perry and Chilton's "Chemical Engineers' Handbook," the disclosure of which is hereby incorporated by reference into this specification. Thus, but way of illustration and not limitation, one can use alloys comprised of molybdenum, Inconel, cobalt-based Stellite 25, iron-based A286, type 502 steel, austenitic stainless steels, steels comprised of silicon, steels comprised of both silicon and chromium, steels comprised of aluminum and the like.

In one preferred embodiment, the material used to make the mesh framework of this invention is galvanized. As used in this specification, the term galvanized refers to a material which is coated with zinc. Galvanized steel is one especially preferred material.

In general, the mesh can be made out of any material which preferably has a tensile strength of from about 80,000 to about 300,000 pounds per square inch.

The rigid mesh framework used in the construction panel of this invention is comprised of a series of interlocking members which define a specified shape. The shape defined by the interlocking members can be square, rectangular, hexagonal, octagonal, circular, and the like. Because of ease of fabrication, it is preferred that the shape defined by the interlocking members be square or rectangular. In the most preferred embodiment, the shape defined by the interlocking members is square.

It is preferred that the rigid mesh framework be made from wire. In this embodiment, it is preferred that the wire be from about 8 gage to about 14 gage. Wire and sheet metal gages are described in Table 1-14 (appearing at page 1-30) of the aforementioned Perry and Chilton's "Chemical Engineers' Handbook," the disclosure of which is hereby incorporated by reference into this specification. In a more preferred embodiment, the gage of the wire is from about 9 to about 13. In the most preferred embodiment, the gage of the wire is from about 10 to about 12. In one embodiment, 12 gage wire is especially preferred.

In the embodiment where the shape defined by the interlocking members is square, it is preferred that the size of the square be from about 1.0"×1.0" to about 3.0"×3.0". It is more preferred that the size of the square be about 2.0"×2.0".

In the embodiment where the shape defined by the interlocking members is rectangular, it is preferred that the ratio of the long side of the rectangle to the short side of the rectangle be from about 5.0/1.0 to about 5.0/3.0. It is preferred that said ratio be about 1.5/1.0.

It is preferred that, when the shape defined by said interlocking members is square, each side of the square be at least 1.0". A shape which is less than 1.0" on any side tends to impede the flow of concrete into and onto the panel and is not preferred.

The construction panel of this invention offers one two independent means of producing high strength support means. One can reduce the size of the shapes defined by the interconnecting members, to a minimum size of about 1.0"×1.0" (when the shape is square) and thereby increase the strength of the panel. Alternatively, or additionally, one can increase the weight of the wire used in the mesh framework, up to about a maximum weight of 8 gage, and also increase the strength of the panel. The weight of the wire on one side of the construction panel and/or the shape defined by the interconnecting members and/or the size of said shapes can be the same as the weight, shape, and size used on the other side. Alternatively, one can use a different weight of wire and/or shape and/or size of the shapes on different sides of the construction panel, depending upon the stresses each side must bear in its intended use.

Figure 10:
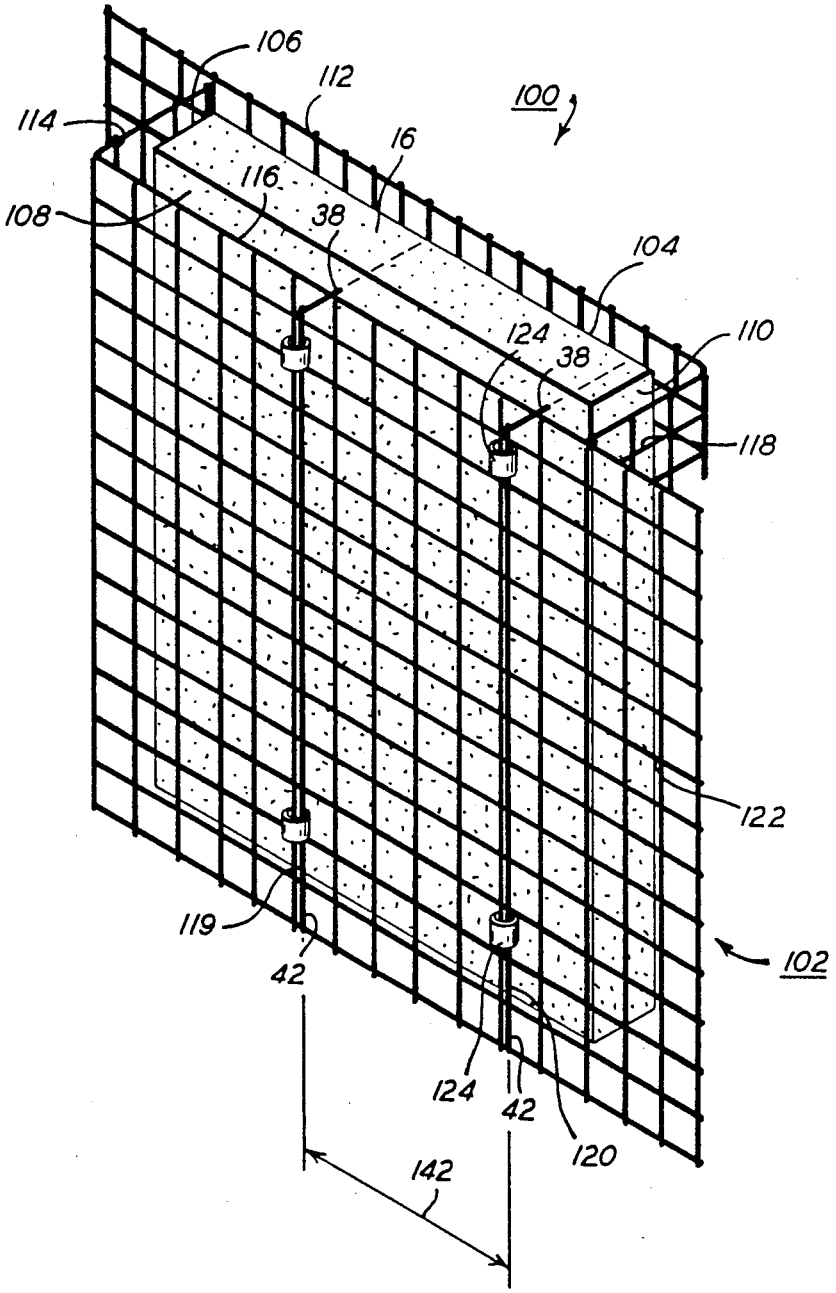
FIG. 10 is a perspective view of one of the preferred construction panels of this invention.

Referring again to FIG. 10, a preferred construction panel within the scope of this invention is illustrated. Construction panel 100 is can be of any shape. Thus, by way of illustration and not limitation, it can be of rectangular shape, square shape, circular shape, oval shape, irregular shape, and the like. Because of ease of fabrication, it is preferred that it be either rectangular or square shaped.

The shape of construction panel 100 will be dictated by the shape of wire mesh framework 102. Wire mesh framework 102 can be of any shape. However, insulating core 16, which is disposed within wire mesh framework 102, should be substantially the same shape as is wire mesh framework 102. If it is not of substantially the same shape as is the wire mesh framework, then at some points it will not form an insulating barrier between the concrete applied to opposite faces of the wire mesh framework.

Each of the exterior faces 104, 106, 108, and 110 of insulating core 16 is preferably spaced from each of the corresponding interior faces 112, 114, 116, and 118 of wire mesh framework 102 so that substantially no portion of said insulating core 16 is contiguous with any portion of wire mesh framework 102. The insulating core 16 may be contiguous with certain specified longitudinal retaining members and transverse retaining members, but these retaining members are not considered for purposes of this specification to be part of wire mesh framework 102.

The exterior face 104 of insulating core 102 is spaced from interior face 112 of wire mesh framework 102 in such a manner that, along the entire surfaces of faces 104 and 112, the distances between said faces are substantially equidistant. Similarly, exterior face 108 of insulating core 16 is spaced from interior face 116 of wire mesh framework 102 in such a manner that, along the entire length of faces 108 and 116, the distances between the faces are substantially equidistant. It is preferred that the distance between exterior face 104 and interior face 112, and between exterior face 108 and interior face 116, be from about 0.5 inches to about 4.0 inches and, preferably, from about 0.5 inches to about 2.0 inches. The most preferred spacing between said faces is from about 0.5 inches to about 1.0 inch.

The spacing between exterior face 104 and interior face 112 may, but need not be, the same as the spacing between exterior face 108 and exterior face 116.

It is preferred that exterior faces 106 and 110 of insulating core 16 be spaced from interior faces 114 and 118, respectively, of wire mesh framework 102 so that, along the entire surfaces of faces 106 and 110, the distances between said faces are substantially equidistant. It is preferred that the distance between exterior faces 106 and 110 and interior faces 114 and 118, respectively, be from about 0.5 inches to about 2.0 inches, although the spacing between exterior face 106 and interior face 114 need not be the same as the spacing between exterior face 110 and interior face 114.

Longitudinal retaining members 119 and 120 contain projections (not shown) which extend from side 122 of wire mesh framework 102 through insulating core 16 to the opposite side (not shown) of wire mesh framework 102. These reinforcing members (prongs) are shown in greater detail in FIG. 3. Instead of being longitudinal, these prongs may be disposed in a transverse and/or diagonal and/or a curved manner across the face of side 122 and/or across the face of the opposing side (not shown).

It is preferred that insulating core 16 be from about 1.0 inches to about 4.0 inches wide. In a more preferred embodiment, said insulating core is from about 1.5 to about 3.0 inches thick. In the most preferred embodiment, said insulating core is from about 1.75 to about 2.25 inches thick.

FIG. 7 illustrates a preferred embodiment in which alignment lips 74 and 76 extend from sides 124 and 126, respective. It is preferred that the length of each of lips 74 and 76 be from about 4 to about 8 inches. In the most preferred embodiment, the length of said lips 74 and 76 is about 8 inches.

Insulating core 16 is preferably a polymeric material such as, e.g., polystyrene, polyurethane, and the like. Polymeric materials are well known to those skilled in the art and are described in, e.g., Brage Golding's "Polymers and Resins", (D. Van Nostrand Company, Inc., Princeton, N.J., 1959), the disclosure of which is hereby incorporated by reference into this specification.

It is preferred that the polymeric material used to prepare insulating core 16 be a cellular structural material in the form of a solid foam. These foamed polymeric materials are well known to those skilled in the art and can be comprised of phenol-aldehyde resins, urea-aldehyde resins, polystyrene, polyethylene, polyurethanes, plasticized poly (vinyl chloride), cellulose acetate, and both natural and synthetic elastomers. These foamed plastics are described on pages 642–647 of B. Golding's "Polymers and Resins", supra, the disclosure of which is hereby incorporated by reference into this case.

In one preferred embodiment, the thermal conductivity of the polymeric material used as insulating core 16 is no greater than 0.09 and, preferably, is no greater than 0.058. The thermal conductivities of selected polymeric materials are described in Table 23-10 which appears on pages 23-62 and 23-63 of the aforementioned Perry and Chilton's "Chemical Engineer's Handbook".

The foam material which can be used in the insulating core 16 of this invention should have a relatively low density, a high compressive strength, and good fire resistance or retardation characteristics. A number of materials meet these requirements in varying degrees and thus are suitable for untilization in the practice of this invention. One suitable type is epoxy foams, which have found extensive use as core material in light sandwich structures for building doors, partitions, and panels. Polystyrene foams are inexpensive, easily processed at low temperatures and pressures, provide good sound insulation, and do not generate toxic fumes when burned. Silicone foams can be used, but the compressive strength is not as high as some of th other types. Rigid urethane foams, which are prepared by reacting hydroxyl-terminated compounds called polyols with a diisocyanate and water in the presence of a catalyst, are a popular material for this type of application. Ureaformaldehydes and vinyls are two other types of foams which can be utilized under proper circumstances.

For a complete discussion of the various types of foams, their preparation and characteristics, see Plastics Engineering Handbook of the Society of Plastic Industry, Inc., chapter 12, Cellular Plastics, pages 136 et seq., third edition, Reinhold Publishing Corporation, New York, N.Y., the disclosure of which is hereby incorporated by reference into this specification.

In one preferred embodiment, polystyrene is used as insulating core 16. The preparation of polystyrene is well known to those skilled in the art and is described, e.g., on pages 506–518 of the aforementioned "Polymers and Resins" text, the disclosure of which is hereby incorporated by reference into this application.

Referring again to FIG. 3, prongs 36 and 38 provide a preferred means of providing the cross-tie separators of this invention. In this preferred embodiment, each of prongs 36 and 38 is provided with a first longitudinal section (40 or 42), a second longitudinal second (32 or 34), and a multiplicity of transverse sections (sections 12 or 14).

First longitudinal section 40 of prong 36 is attached to wire mesh framework 54, and the tines 12 of prong 36 are attached to wire mesh framework 52. First longitudinal section 42 of prong 36 is attached to wire mesh framework 52, and the tines 14 of prong 38 are attached to wire mesh framework 54.

The first longitudinal sections 40 and 42 of prongs 36 and 38 are attached to adjacent wire mesh framework 54 or 52, respectively, by conventional means.

Referring again to FIG. 10, each of prongs 38 is separated by a distance 142. Each of prongs 36 (not shown) is also separated by a distance (not shown), and it is preferred that the distance between adjacent prongs 38 be equal to the distance to adjacent prongs 36. It is preferred that adjacent prongs 38, and adjacent prongs 36, be disposed substantially parallel to each other. Thus, e.g., in FIG. 10, longitudinal members 42 of prong 38 are parallel to each other.

The distance between adjacent prongs 36 and adjacent prongs 38, such as distance 142, should not exceed about 12 inches. It is preferred that the distance between adjacent prongs 36 and adjacent prongs 38, such as distance 142, be no greater than about 10 inches. It is even more preferred that said distance not exceed 8 inches. In the most preferred embodiment, the distance between adjacent prongs 36 and between adjacent prongs 38, such as distance 142, does not exceed about 6 inches.

Each prong can be spaced at the same distance from each adjacent prong 36, and each prong 38 can be spaced at the same distance from each adjacent prong 38, and this is preferred. Alternatively, one can use different spacings between different pairs of adjacent prongs 36 and/or different pairs of adjacent prongs 38. In one preferred embodiment, the spacing between each pair of adjacent prongs 36 is equal to both the spacing between every other pair of adjacent prongs 36 and each and every pair of adjacent prongs 38.

The manner in which prongs 36 and 38 form the cross-tie separators of this invention is illustrated in FIG. 4. Tines 12 and 14 form wire pairs 144, 146, 148 and 150. The manner in which each of these wire pairs forms a cross-tie separators is illustrated by reference to wire pair 144. The wire pair clamps opposing faces of the foam insulation core fixedly in pace. Prong 36 is inserted through foam insulatin core 16 until its longitudinal wire 32 is contiguous with face 48 of insulating core 16; tine 12 is secured to face 52 of the wire mesh framework at point 58; and longitudinal wire 40 of prong 36 may be secured to face 55 of the wire mesh framework by clips 124. Prong 38 is inserted through foam insulation core 16 until its logitudinal wire wire 34 is contiguous with face 50 of insulating core 16; tine 14 is secured to face 54 of insulating core 16 at point 56; and longitudinal wire 42 of prong 38 may be secured to face 53 of the wire mesh framework by clips 124. These sets of opposing prongs 36 and 38, because they are secured to the wire mesh framework and are preferably contiguous, perform two very important functions: (1) they hold insulating core 16 rigidly in place, and (2) they give the construction panel rigidity and structural integrity.

Each of prongs 36 and 38 can be made out of galvanized steel on the aforementioned GZ "Wire mesh welding machine for light wire mesh." The prongs are made from about 8 to about 14 gage wire. In one embodiment, the prongs are made out of 12 gage galvanized steel, the length of each of the tines 12 and tines 14 is 4.0 inches, and the distance between wires 40 and 32 (or between wires 34 and 42) is 0.5 inch.

Figure 11:
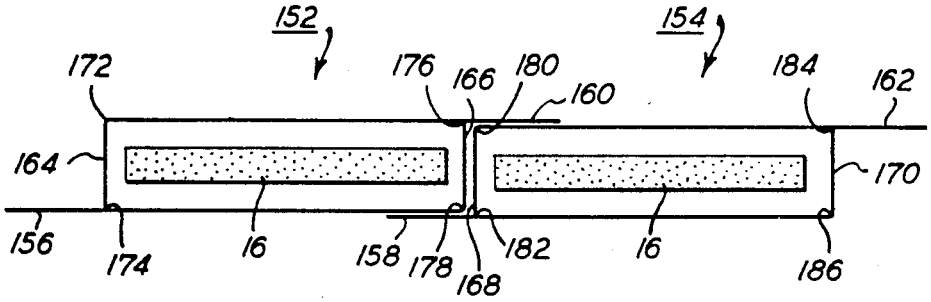
FIG. 11 illustrates the utility of the alignment guides used in the panel of this invention.

FIG. 11 illustrates how the construction panels of this invention are aligning. Construction panels 152 and 154 are shown without prongs 36 and 38, but it is to be understood that the construction panel of this invention is comprised of these members. These construction panels 152 and 154 are comprised of alignment guides ("lips") 156, 158, 160 and 162. These alignment guides are integral with the wire mesh framework; they are characterized by being formed from the same piece of wire mesh which is bent and secured to form the wire mesh framework (see FIGS. 4 and 5). This integral, one-piece characteristic of the alignment guides provides good strength properties to the construction panel.

It is preferred that the short sides of the construction panel, sides 164, 166, 168 and 170, be substantially equal to each of the other short sides in the construction panel. Thus, referring to FIG. 11, short side 164 is the same length as short side 166, and short side 168 is the same length as short side 170.

In a more preferred embodiment the angle 172, 174, 176, 178, 180, 182, 184, and 186 formed between any of the short sides of the wire mesh framework and any of the long sides is substantially 90 degrees. Some deviation from a perfect right angle is permissible, but generally such an angle is from about 85 to about 95 degrees in this embodiment. The term "substantially rectilinear" is used in this specification to refer to this embodiment in which (1) each of the short sides in the wire mesh framework is of equal length, and (2) the angle formed between each of said short sides and each of said long sides is substantially a right angle.

Figure 12:
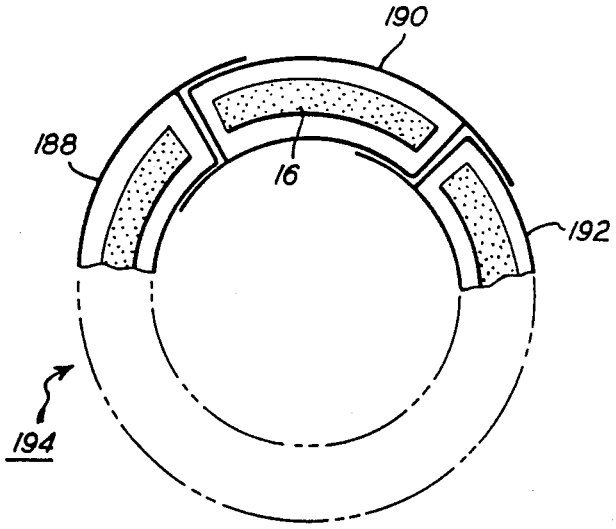
FIG. 12 illustrates a curved structure which can be built with the building panel of this invention.

FIG. 12 illustrates another embodiment of the invention in which construction panels 188, 190 and 192 (and other construction panels, not shown) are manufactured in a curved configuration and assembled together to form a curved structure 194. These Figures also do not show the reinforcing members for the purpose of simplicity, but it is to be understood that said members comprise the panel of this invention.

Figure 13:
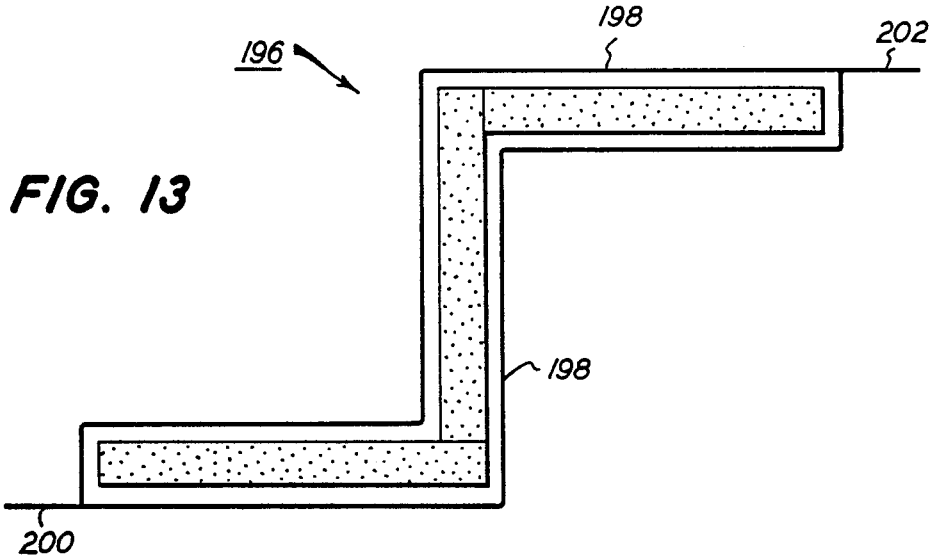
FIGS. 13, 14, 15, 16, 17, and 18 each illustrate a particular use of the building panels of this invention.

FIG. 13 illustrates another embodiment of the invention in which panel 196 is comprised of one-piece wire mesh framework 198 and alignment guides 200 and 202.

Figure 14:
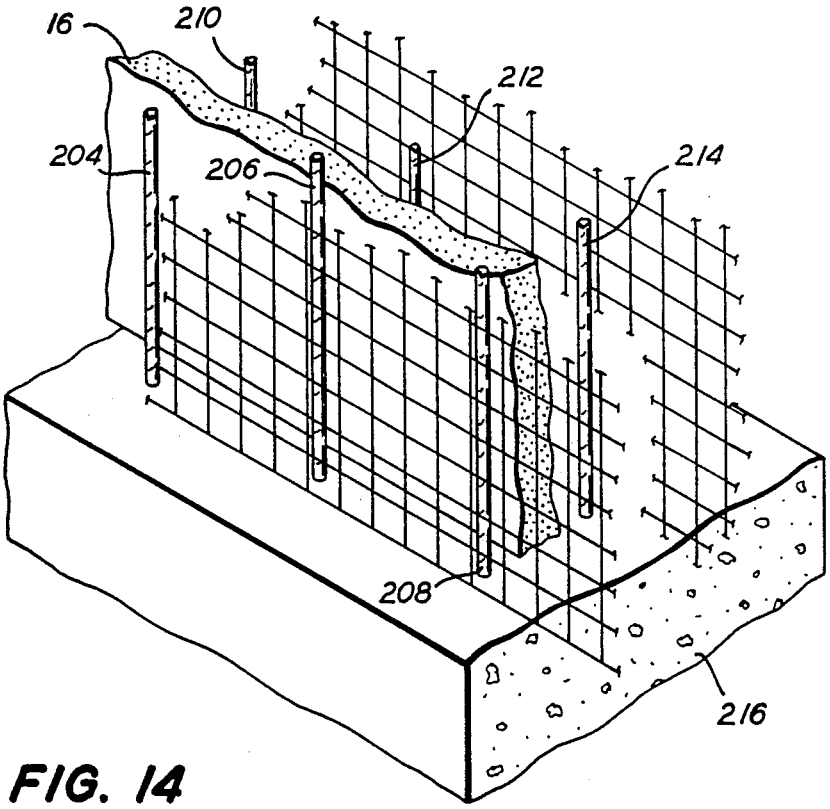

FIG. 14 illustrates one preferred means for utilizing the construction panel of the invention. Concrete retaining rods 204, 206, 208, 210, 212, and 214 are fastened in and secured to foundation 216 by conventional means. Thereafter, the construction panel is inserted over these retaining rods so that each of these retaining rods extends between the interior surface of the wire mesh framework and the exterior wall of the insulating core.

Figure 15:
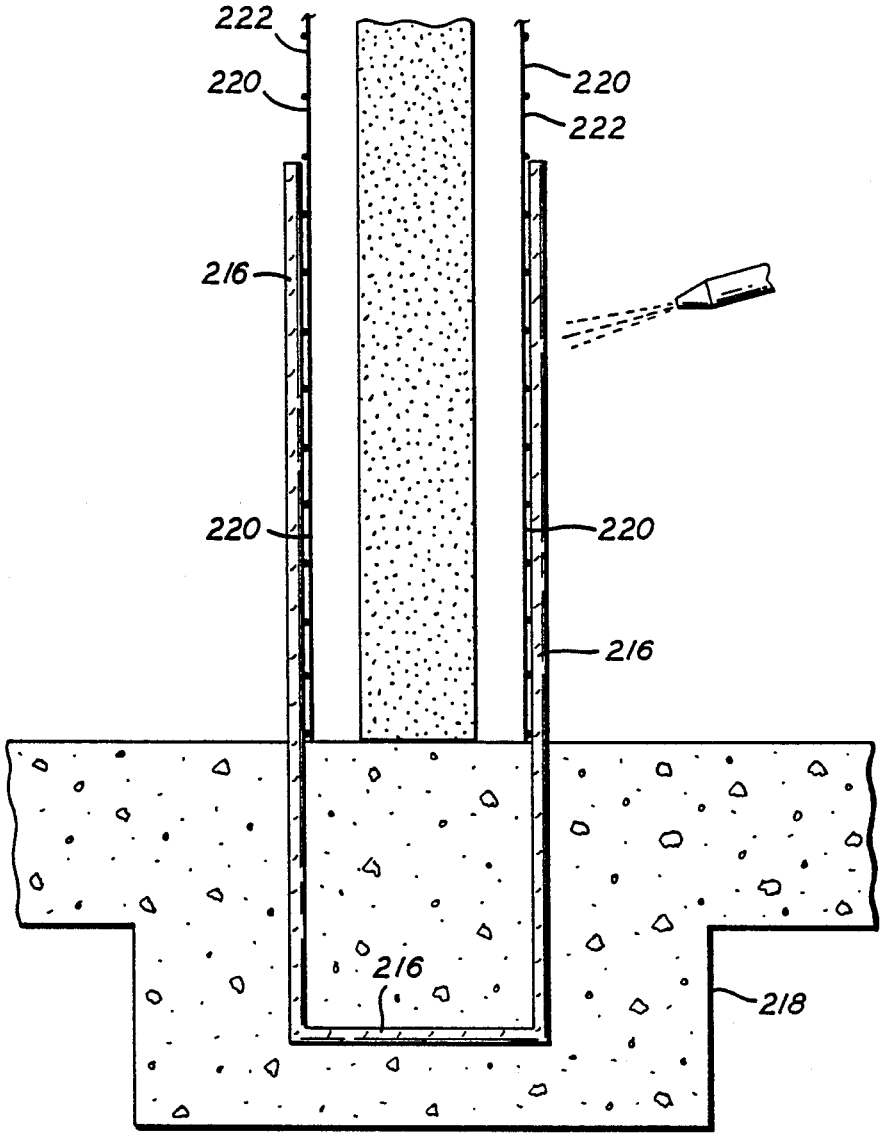

FIG. 15 illustrates another embodiment of the invention. U-shaped retaining rod 216 is inserted and fixed to foundation 218. U-shaped rod is configured in such a manner that the rod goes outside the exterior faces 220 of the wire mesh framework 222. In one preferred embodiment (not shown) however, the rod goes between the interior face of the wire mesh framework 222 and the exterior face of insulating core 16. After the rod is inserted into the framework, the framework is sprayed with material.

The term cementitious material, as used in this specification, refers to mortar, concrete, plaster, stucco, and the like.

In one embodiment, not shown, instead of spraying cementitious material onto the wire mesh framework, a polymeric thermosetting material is sprayed onto the framework. Suitable materials include "STYROFOAM", polyurethane, unsaturated polyesters, and the like.

Figure 16:
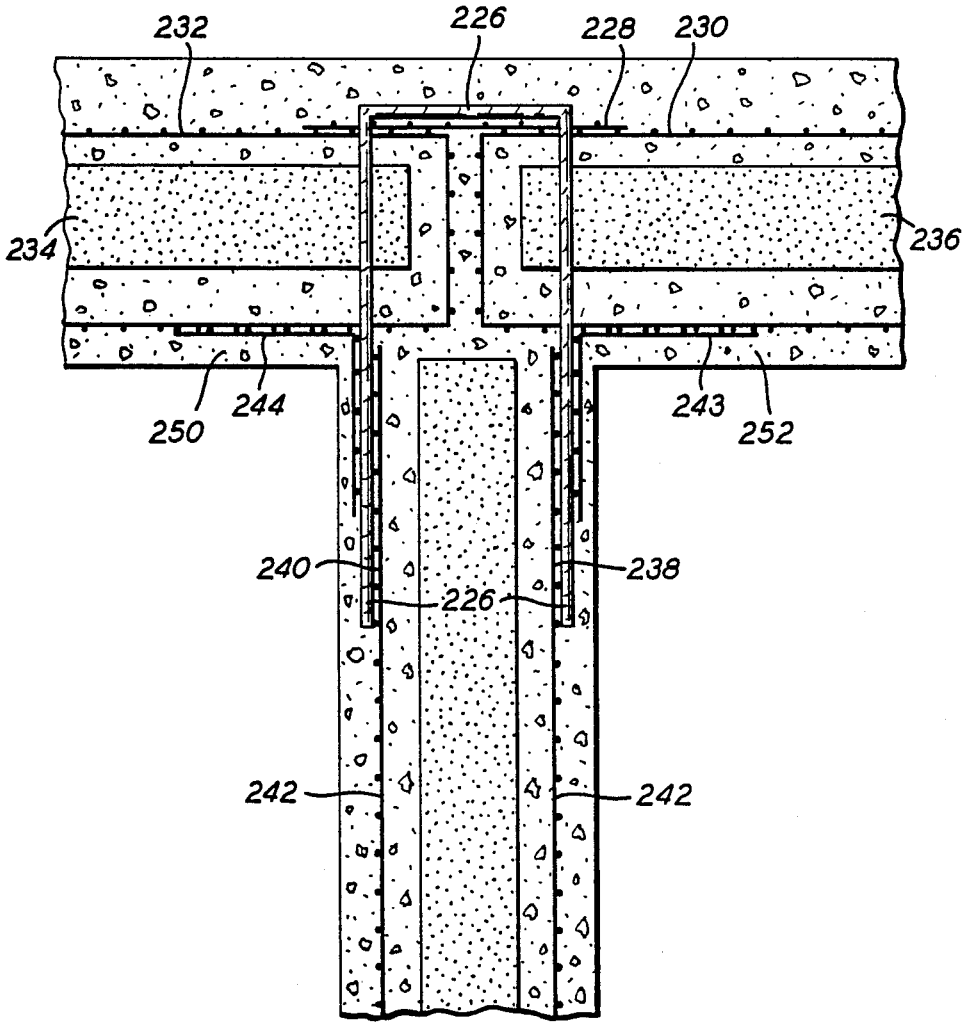

FIG. 16 illustrates another preferred embodiment of the invention in which the construction panels are used to create a ceiling structure. U-shaped retaining 226 is passed through wire mesh 228, wire mesh frameworks 230 and 232, insulating cores 234 and 236, and outside of the exterior walls 238 and 240 of wire mesh framework 242. Portions of wire mesh retaining rods 243 and 244 are then placed outside of retaining rod 226 and exterior walls 238 and 240, and the construction panels are then sprayed with concrete to embed the wire mesh frameworks. Concrete is also sprayed into crevices 250, and 252.

Figure 17:
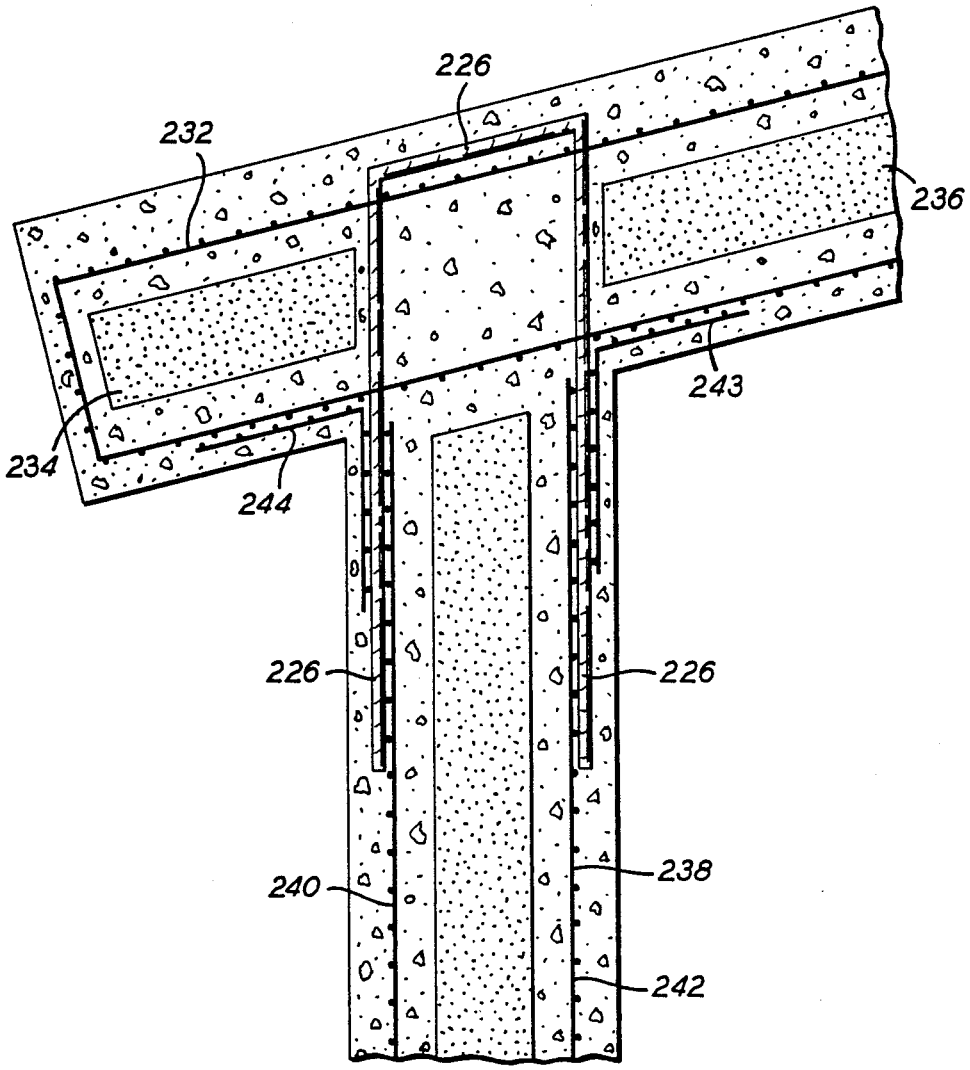

FIG. 17 illustrates another preferred embodiment of the invention in which U-shaped retaining rod 226 is passed through only one substantially transverse wire mesh framework and then, as is the case with FIG. 16 used to secure the wire mesh framework.

Figure 18:
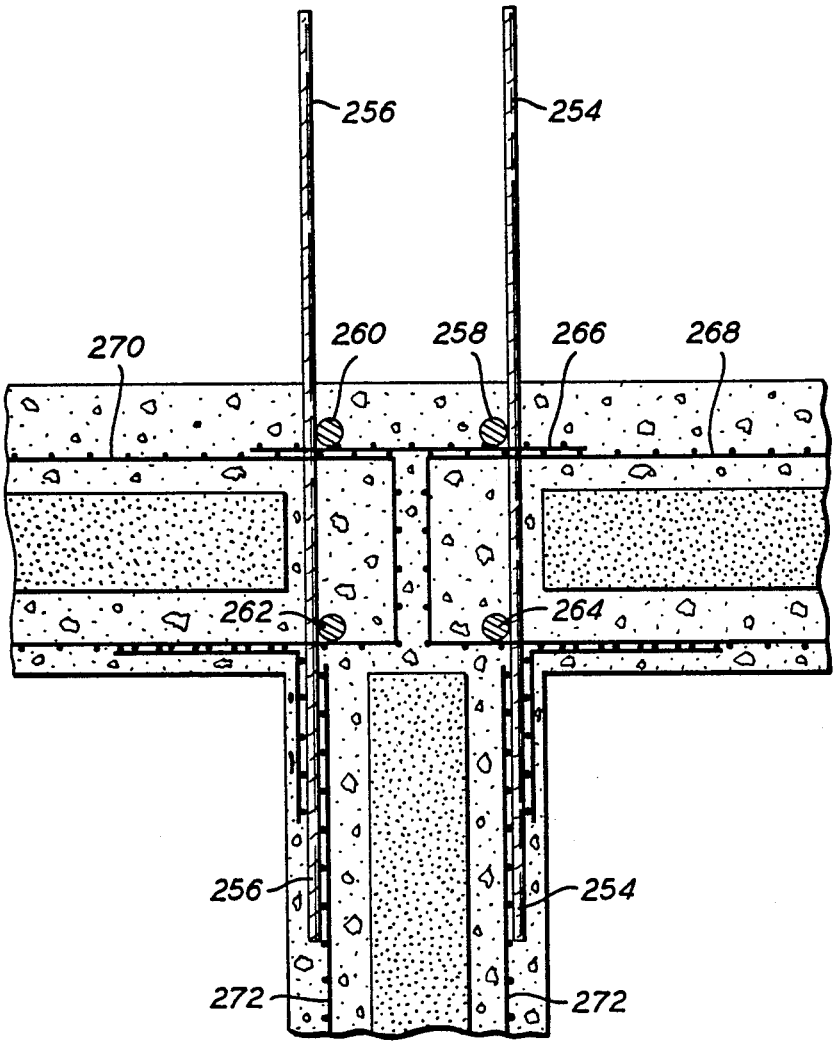

FIG. 18 illustrates yet another preferred embodiment in which the construction panels of this invention can be disposed in various directions. Retaining rods 254 and 256 extend upwardly, and they can be used to secure one or more construction panels in the manner illustrated in the prior Figures. Transverse retaining rods 258, 260, 262, and 264 extend in and out of the plane of the paper; they are secured by retaining rod 256 and/or wire mesh 266 and/or wire mesh framework 268 and/or wire mesh framework 270; and they can be used to secure one or more construction panels in the manner illustrated in the prior drawings. Retaining rods 254 and 256 are also used to secure wire mesh framework 272.

The following examples are presented to illustrate the claimed invention but are not to be deemed limitative thereof. Unless otherwise stated, all parts are by weight and all temperatures are in degrees centigrade.

EXAMPLE 1

In this example, a rectangular wall panel as shown in FIGS. 1–17 of this specification was provided. The wire mesh framework was made from 14 gage galvanized steel; this framework was 1.135 meters long by 2.15 meters high by 0.101 meters wide; and the shapes defined by the interconnecting wire mesh members were 2.0"×2.0" squares. Disposed within the wire mesh framework was a rectangular polystyrene core which was 2.15 meters high by about 1.11 meters long by about 0.76 meters wide; there was a space of about 0.0254 meters between the inner surfaces of the wire mesh framework 12 and the exterior surfaces of the foamed polystyrene core; and this polystyrene core was held in place by a series of prongs 36 and 38, each of which extended from the top of the wire mesh framework to the bottom of the wire mesh framework. Each of the prongs 36 and 38 were comprised of a series of horizontally extending tines 12 or 14 which extended from one side of the wire mesh framework 12, through the polystyrene core, and to the other side of the wire mesh framework; each of the horizontally extending tines were each about 0.152 meters long before being bent around the opposing face of the wire mesh framework to secure the polystyrene foam core in place; each of the horizontally extending tines were spaced about 5.0 inches from each adjacent such member, and each prong 36 or prong 38 was spaced 6.0 inches from the adjacent prong 36 or prong 38.

Mortar with a resistance of 180 kilograms/square centimeter (after 28 days) was sprayed onto the faces of the construction panel. 492.80 kilograms of this mortar were sprayed onto the panel such that each of the faces of the wire mesh framework was embedded in mortar and the mortar extended at least about 0.175 centimeters from the embedded faces of the framework.

This structural form panel was tested in accordance with the procedure specified in A.S.T.M. test E72-80, section (Compressive Load test for walls). The maximum compressive load the sample was able to withstand was 98,000 kilograms, and the load per lineal meter was 86,343 kilograms per meter.

EXAMPLE 2

In substantial accordance with the procedure of Example 1, two structural foam wall panels were prepared. These panels had different dimensions than the panel of Example 1 (being 30 centimeters long by 30 centimeters high by 12 centimeters wide), but substantially everything else about their structure and composition was the same.

Each of the panels was subjected to five cycles of humidity and heat. Each cycle involved placing the sample in a chamber at 100 percent relative humidity for 24 hours, and thereafter subjecting the sample to a temperature of 60 degrees centigrade for 24 hours in a furnace. During and after the five cycles, measurements were made of the dimensions weight of the sample. The weight of the sample, after the five cycles, did not increase more than 4.0 percent. The dimensions of the sample, after the five cycles, did not change more than 4.0 percent. No breaks in or deterioration of the sample was noticed.

EXAMPLE 3

A roof panel was prepared in substantial accordance with the procedure of Example 1, with the following differences: (1) 12 gage galvanized steel was used to make the wire mesh framework 12, (2) the framework was 1.40 meters long by 3.50 meters high by 0.101 meters wide, (3) the polystyrene core disposed within the framework was situated 3.81 centimeters from the top face of the panel and 2.54 centimeters from the bottom face of the panel, (4) sufficient mortar was sprayed onto the top face of the panel so that the top face was embedded in mortar and the mortar extended 9.0 centimeters above the top face, and (5) sufficient mortar was sprayed onto the bottom face of the panel so that the bottom face was embedded in mortar and the mortar extended 2.0 centimeters below the bottom face. The total width of the panel, with the concrete on and in it, was 0.21 centimeters.

The panel was tested in accordance with ASTM test E72-80, Section 20 ("TESTING ROOFS . . . Transverse Loads"). The width of the testing panel used was 3.35 meters. The panel was subjected to increasing force until the force on the panel was 2,087 kilograms per square meter; even at this force, however, the panel did not break.

EXAMPLES 4 AND 5

Two wall panels were prepared in substantial accordance with the procedure of Example 1. The panel of Example 4 was 1.38 meters long by 2.60 meters high by 11.5 centimeters wide. The panel of Example 5 was 1.39 meters long by 2.63 meters high by 11.5 centimeters wide.

These panels were tested for impact strength in accordance with A.S.T.M. E72-80. The panel of Example 4 had a deflection (in centimeters) of 0, 0, 0, 1.0, 1.5, 1.5, 2.0, 2.0, and 2.0 at a drop height (in centimeters) of 0, 30, 60, 90, 120, 150, 180, 210, 240 and 250, respectively. The panel of Example 5 had a deflection (in centimeters of 0, 0, 0.3, 0.5, 1.0, 1.0, 1.5, 1.5, 1.5, and 2.0 at a drop height (in centimeters) of 0, 30, 60, 90, 120, 150, 180, 210, 240, and 350 centimeters, respectively.

A latitude of modification, change, and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A construction panel comprised of a wire mesh framework, an insulating core fixedly disposed within said wire mesh framework, and at least 2.0 cross-tie separators per square foot of said construction panel, wherein:

(a) said wire-mesh framework is a closed, four-sided structure comprised of a front side, a back side, a left side, a right side, a first alignment guide, and a second alignment guide, wherein:

1. each of said front side and said back side is longer than each of said left side and said right side,
2. said left side and said right side are equal in length,
3. said first alignment guide is connected to and forms a first, integral, one-piece, L-shaped structure with said front side and said right side.

4. said second alignment guide is connected to and forms a second, integral, one-piece, L-shaped structure with said back side and said left side,
5. said first L-shaped structure and said second L-shaped structure are connected to each other to form said closed, four-sided structure comprised of said first alignment guide and said second alignment guide,
6. said first alignment guide extends past the point where said front side is contiguous with and is connected to said right side, and
7. said second alignment guide extends past the point where said back side is contiguous with and is connected to said left side; and (b) said insulating core is fixedly disposed within said wire mesh framework by a multiplicity of prongs, wherein:
1. each of said prongs is comprised of a first vertical wire, a second vertical wire, and a mulitplicity of transversely-extending tines, each one of which tines is connected to both of said first vertical wire and said second vertical wire,
2. each of said first vertical wires of said prongs is attached to the front or back side of said wire mesh framework,
3. each of said second vertical wires of said prongs is contiguous with one face of said insulating core, and
4. each of said transversely-extending tines is attached to that side of the wire mesh framework which is opposite to that side of the framework to which the first vertical wire of the prong on which the tine is located is attached.

2. The construction panel as recited in claim 1, wherein the angles formed between said left side and each of said front side and said back side of the wire mesh framework are both about 90 degrees.

3. The construction panel as recited in claim 2, wherein the angles formed between said right side and each of said front side and said back side of the wire mesh framework are both about 90 degrees.

4. The construction panel as recited in claim 3, wherein said front side and said back side of the wire mesh framework are each longer than said left side and said right side of the wire mesh framework, wherein said front side and said back side are equal in length, and wherein said front side, said right side, said back side, and said left side define a rectangular shape.

5. The construction panel as recited in claim 4, wherein said first alignment guide extends past the point where said front side is contiguous with and and is connected to said right side by at least about six inches.

6. The construction panel as recited in claim 5, wherein said second alignment guide extends past the point where said back side is contiguous with and is connected to said left side by at least about six inches.

7. The construction guide as recited in claim 6, wherein each of said transversely-extending tines of said prongs forms an angle of about 90 degrees with each of said first vertical wire and said second vertical wire of the prong to which the tine is attached, and wherein each of said first vertical wire and said second vertical wire are parallel to each other.

8. The construction panel as recited in claim 7, wherein said construction panel is comprised of at least about 2.5 cross-tie separators per square foot of said construction panel.

9. The construction panel as recited in claim 8, wherein said construction panel has an adjusted weight of less than 0.8 pounds per square foot.

10. The construction panel as recited in claim 9, wherein said construction panel is comprised of at least about 3.0 cross-tie separators per square foot of construction panel.

11. The construction panel as recited in claim 10, wherein each of said transversely-extending tines passes through said insulating core, intersects opposing faces of said insulating core, and forms an angle of about 90 degrees at each point it intersects a face of said insulating core.

12. The construction panel as recited in claim 11, wherein, on each of said prongs, each of said transversely-extending tines is substantially parallel to each of the other tines on the prong.

13. The construction panel as recited in claim 12, wherein the ratio of the long side to the short side in the rectangular shape defined by said front side, back side, left side, and right side of said wire mesh framework is from about 5.0/1.0 to about 5.0/3.0.

14. The construction panel as recited in claim 13, wherein said wire mesh framework is comprised of a series of interlocking members which define a multiplicity of square shapes.

15. The construction panel as recited in claim 14, wherein the size of the square shapes defined by the interlocking members of the wire mesh framework is from about 1.0 inch×1.0 inch to from about 3.0 inch×3.0 inch.

16. The construction panel as recited in claim 15, wherein said insulating core consists essentially of a polymeric, cellular structural material.

17. The construction panel as recited in claim 16, wherein said insulating core consists essentially of polystyrene.

18. The construction panel as recited in claim 17, wherein said polystyrene insulating core is from about 1.0 to about 4.0 inches thick.

19. The construction panel as recited in claim 18, wherein said prongs are parallel to each other, and adjacent prongs are no more than about eight inches away from each other.

20. The construction panel as recited in claim 19, wherein said adjacent prongs are no more than about 6 inches away from each other.

* * * * *